US005353452A

United States Patent [19]

Rulis

[11] Patent Number: 5,353,452

[45] Date of Patent: Oct. 11, 1994

[54] FOLDING BED ASSEMBLY

[76] Inventor: Robert A. Rulis, 3510 Larimer St., Denver, Colo. 80205

[21] Appl. No.: 117,627

[22] Filed: Sep. 8, 1993

[51] Int. Cl.[5] ..... A47C 17/40

[52] U.S. Cl. ..... 5/136; 5/159.1; 5/160; 5/164.1; 5/400

[58] Field of Search ..... 5/136, 159.1, 160, 164.1, 5/186.1, 400

[56] References Cited

U.S. PATENT DOCUMENTS

| | | | |
|---|---|---|---|
| 212,348 | 2/1879 | Blackman . | |
| 215,134 | 5/1879 | Kiss . | |
| 219,078 | 9/1879 | Dupre . | |
| 269,985 | 1/1883 | Adgate . | |
| 348,643 | 9/1886 | Strahan . | |
| 370,426 | 9/1887 | Stark . | |
| 379,449 | 3/1888 | Condell . | |
| 380,258 | 3/1888 | Herrington . | |
| 403,850 | 5/1889 | Merrill . | |
| 403,851 | 5/1889 | Merrill . | |
| 411,641 | 8/1889 | Brown . | |
| 415,013 | 11/1889 | Appleton et al. . | |
| 415,945 | 11/1889 | Hungus . | |
| 439,444 | 10/1890 | Tracy . | |
| 476,876 | 6/1892 | English . | |
| 529,944 | 11/1894 | Opel . | |
| 637,670 | 11/1899 | Sanor . | |
| 734,363 | 7/1903 | Pyle . | |
| 861,452 | 7/1907 | Freeland . | |
| 915,651 | 3/1909 | Appel . | |
| 1,059,497 | 4/1913 | Smith | 5/164.1 |
| 1,094,684 | 4/1914 | Snyder . | |
| 1,108,335 | 8/1914 | Carter . | |
| 1,205,316 | 11/1916 | Barnum . | |
| 1,229,722 | 6/1917 | Creso . | |
| 1,398,727 | 11/1921 | Kozlosky . | |
| 1,584,978 | 5/1926 | Cane et al. . | |
| 1,606,596 | 11/1926 | Peek . | |
| 1,628,763 | 5/1927 | Bayer . | |
| 1,635,806 | 7/1927 | Young | 5/164.1 X |
| 1,885,999 | 11/1932 | Ellsworth . | |
| 1,915,507 | 6/1933 | Wright . | |
| 1,918,085 | 7/1933 | Cocks . | |
| 1,945,826 | 2/1934 | Sinclair . | |
| 1,953,018 | 3/1934 | Lauterstein . | |
| 2,671,230 | 3/1954 | Potter | 5/160 X |
| 2,779,032 | 1/1957 | Van Der Sluys . | |
| 2,788,528 | 4/1957 | Hansen . | |
| 3,046,572 | 7/1962 | Eames et al. | 5/136 |
| 3,097,369 | 7/1963 | Emch | 5/164.1 X |
| 3,116,494 | 1/1964 | Bennett . | |
| 3,179,956 | 4/1965 | Bennett . | |
| 3,359,927 | 12/1967 | Janus . | |
| 3,464,070 | 9/1969 | Driver . | |
| 3,522,615 | 8/1970 | Tudisco . | |
| 3,550,167 | 12/1970 | Bennett . | |
| 3,550,168 | 12/1970 | Woodford . | |
| 3,703,735 | 11/1972 | Moore . | |
| 3,846,852 | 11/1974 | Mercier . | |
| 3,851,344 | 12/1974 | Zeithammer . | |
| 3,863,281 | 2/1975 | Tosic . | |

(List continued on next page.)

OTHER PUBLICATIONS

Brochure: "Wallbeds Plus: Wall Beds and Space-Saving Furniture".

Brochure: "M Murphy TM Beds by Matyja".

Brochure: "Cabinets fro the SICO Room Makers® Modular Wall and Bed System".

Brochure: "The Original Murphy Bed TM".

*Primary Examiner*—Michael F. Trettel

[57] ABSTRACT

A folding bed assembly including a box-shaped support assembly connected to a wall, a box-shaped bed pad pivotally connected to the support assembly with a counter-balancing member connected between the support assembly and the bed pad to bias the pad toward a vertical position, and a bed foot pivotally connected to the bed pad and configured to allow the foot to vertically swing between positions for storage and support of the bed pad, respectively, and wherein the bed foot includes a handle. The bed pad is configured with a partially hollow construction. The bed pad also includes a transverse axle therethrough for pivotal connection with the support assembly.

4 Claims, 5 Drawing Sheets

U.S. PATENT DOCUMENTS 3,877,086 4/1975 Bue et al. .
3,965,498 6/1976 Boni .
4,103,373 8/1978 Luedtke et al. .
4,329,746 5/1982 Bergerud .
4,370,766 2/1983 Teague, Jr. .
4,466,147 8/1984 Yokoi et al. .
4,589,152 5/1986 Pakosh .
4,736,476 4/1988 Maqueira .
4,766,623 8/1988 Belhoffer et al. .
4,885,813 12/1989 McNamara .
4,901,382 2/1990 Spitz .
4,974,271 12/1990 Spitz .
4,999,864 3/1991 Crews .
4,999,865 3/1991 Sauder et al. .
5,033,134 7/1991 Burchett ..... 5/159.1 X FIG. 10
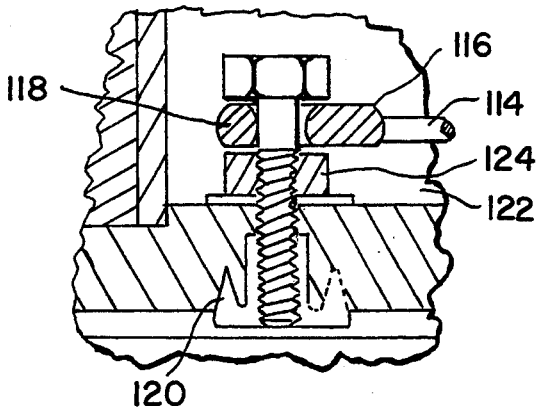
FIG. 11
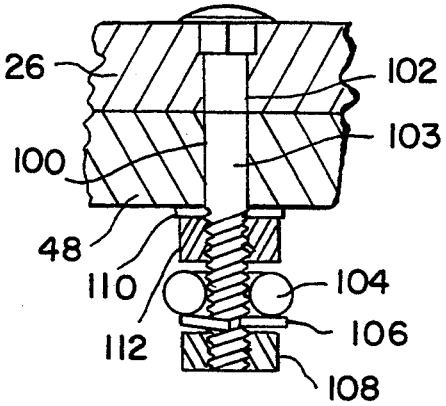
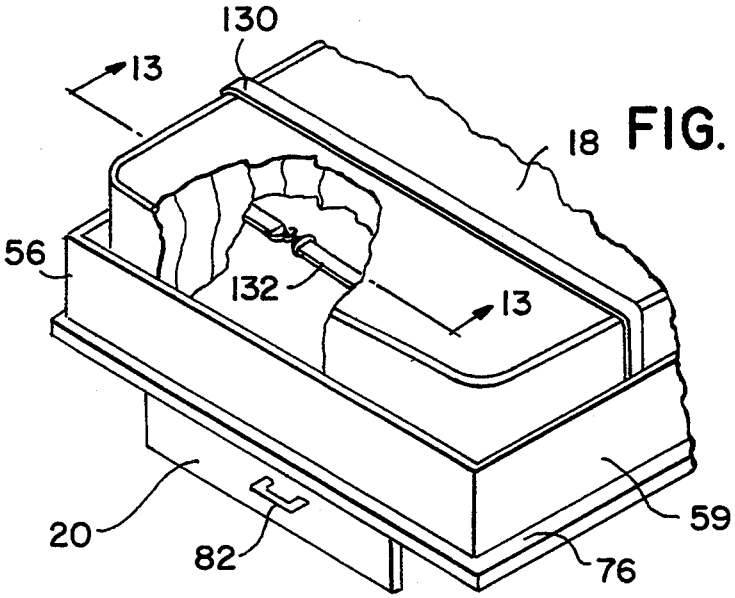
FIG. 12
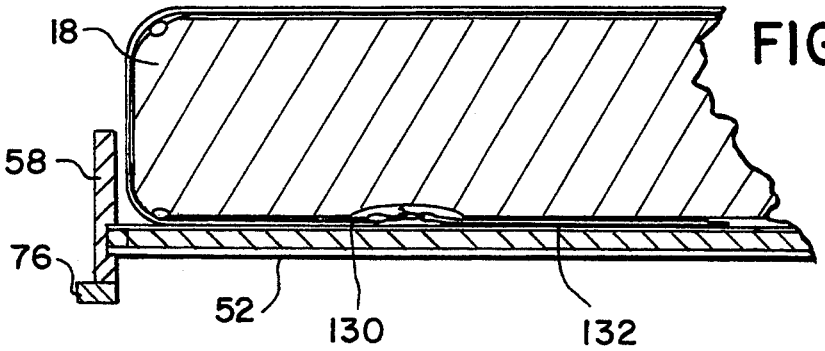
FIG. 13
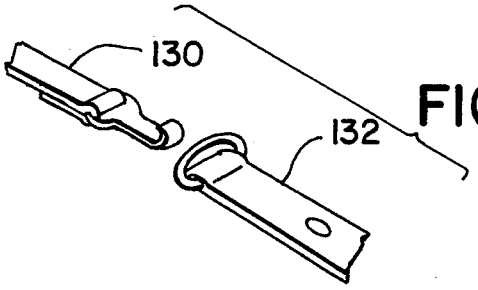
FIG. 14

FOLDING BED ASSEMBLY

The present invention pertains to folding bedsteads and bed assemblies, and more particularly to wall beds. More specifically, the present invention relates to a folding bed frame assembly with improvements specifically to foot supports, counter-balance members, bed frame and pad assembly, and pivotal connection between the bed frame and a cabinet.

BACKGROUND OF THE INVENTION

Folding bedsteads or bed frame assemblies are old and well known. In part, such assemblies have earned a reputation as being cumbersome, overly complex, heavy, unreliable, and uncomfortable. Accordingly, many of the improvements over the years have been directed to appearance, comfort and reduced complexity.

Typically, folding bed assemblies include a cabinet or shell connected to or built into a wall and may have included a plurality of drawers, shelves or the like. The bedstead conventionally includes a bed frame connected within the cabinet and moveable between a horizontal and a vertical position. The bed frame typically includes a plurality of legs extending therefrom to vertically support the bed on the floor in the open position and handles to open the bed. Springs are often connected between a head rail of the bed frame and the cabinet to counter-balance the weight of the bed frame so that the bed frame is easier to raise into a closed position and so that the effect of the force of gravity encountered in opening the bed frame is reduced thereby.

Particularly, the legs of typical folding bed assemblies have suffered from several disadvantages. Often, legs of folding bed assemblies are fixedly mounted to the bed frame to extend therefrom and are unsightly when the bed is in the closed position. Some designs include legs which may be manually extended and retracted when it is desired to place the bed assembly in open and closed positions, respectively. Other designs of folding bed assemblies include complex techniques for extending and retracting the legs such as by pulleys, mechanical linkages and the like.

Another drawback of typical folding bed assembly designs is the undesirably excessive weight of the assembly. This increased weight puts a strain on the connection of a cabinet to the wall as well as on the user who must open and close the bed assembly. Often, the excessive weight is counter-balanced by a complex scheme which itself may be heavy, expensive and/or partially ineffective. The excessive weight of folding bed assemblies is due to a variety of factors. First, many folding bed assemblies are composed of metal members for strength. Second, for purposes of comfort, many folding bed assemblies include a metal spring region in which the mattress rests or, alternatively, a provision for accepting a standard box spring in additional to a bed mattress. If the weight of the folding bed assembly could be decreased, the connection of the cabinet to the wall as well as the means for counter-balancing the bed frame could be greatly simplified and the task of opening and closing the bed assembly would be facilitated.

Another disadvantage of typical folding bed assemblies is the connection of the bed frame to the shell or cabinet. This connection is typically unreliable and complex. It is desirable to improve this connection to increase reliability and reduce weight.

It is against this background and with the desire to provide a folding bed assembly without the limitations of the prior art that the apparatus embodying the present invention has been created.

SUMMARY OF THE INVENTION

The folding bed assembly of the present invention includes a support assembly connected to a vertical support surface, a bed pad for supporting a bed mattress and pivotally connected to the support assembly, a counter-balancing member connected between the support assembly and the bed pad to bias the bed pad toward a vertical position, and a bed foot pivotally connected to the bed pad to allow the foot to gravitationally swing between a vertical and horizontal position as necessary for storage and support of the bed pad, respectively, wherein the bed foot includes a handle.

Another aspect of the present invention includes providing an optimal relationship between the pivotal connection between bed pad and the support assembly and the pivotal connection between the counter-balancing member and the bed pad.

Another aspect of the present invention includes configuring the support assembly and the bed pad in a box-shape so that the bed pad can be received within the support assembly.

Another aspect of the present invention includes a bed pad which is pivotally connected to a support assembly and including a partially hollow construction.

A further aspect of the present invention includes a transverse axle within the bed pad for pivotally connecting the pad to the support assembly.

Other aspects, features and details of the present invention can be more completely understood by reference to the following detailed description of the preferred embodiment, taken in conjunction with the drawings, and from the appended claims.

DETAILED DESCRIPTION OF THE DRAWINGS

FIG. 10 is a section taken along line 10—10 of FIG. 4.

FIG. 11 is a section taken along line 11—11 of FIG. 4.

FIG. 12 is an isometric view of a foot end of the folding bed assembly shown in FIG. 1 showing a portion cut away to illustrate a portion of a mattress strap and anchor.

FIG. 13 is a section taken along line 13—13 of FIG. 12.

FIG. 14 is an isometric view of a portion of the mattress strap and anchor of FIG. 12.

DESCRIPTION OF THE PREFERRED EMBODIMENT

Figure 1:
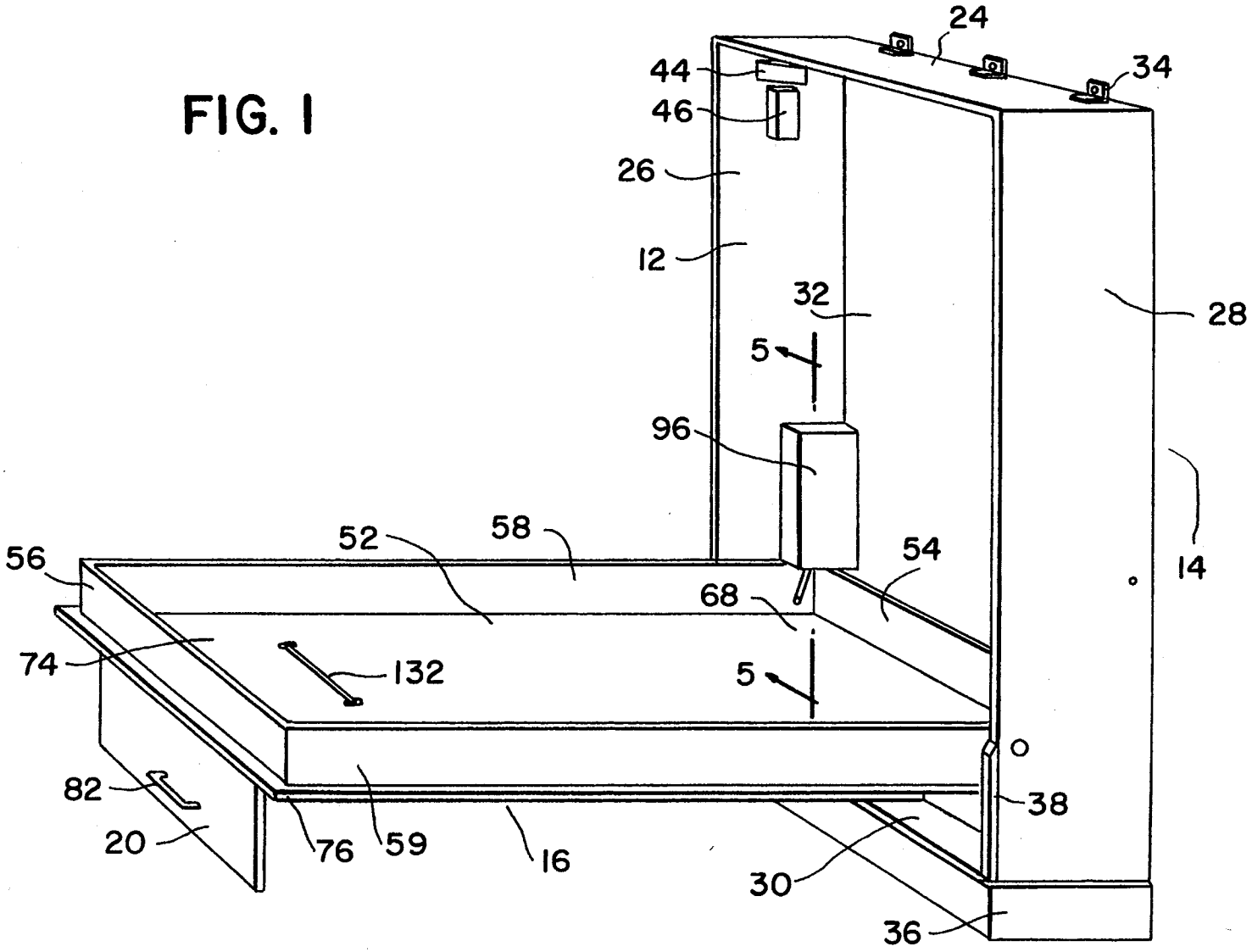
FIG. 1 is an isometric view of a folding bed assembly embodying the present invention and showing it in an open position.
Figure 4:
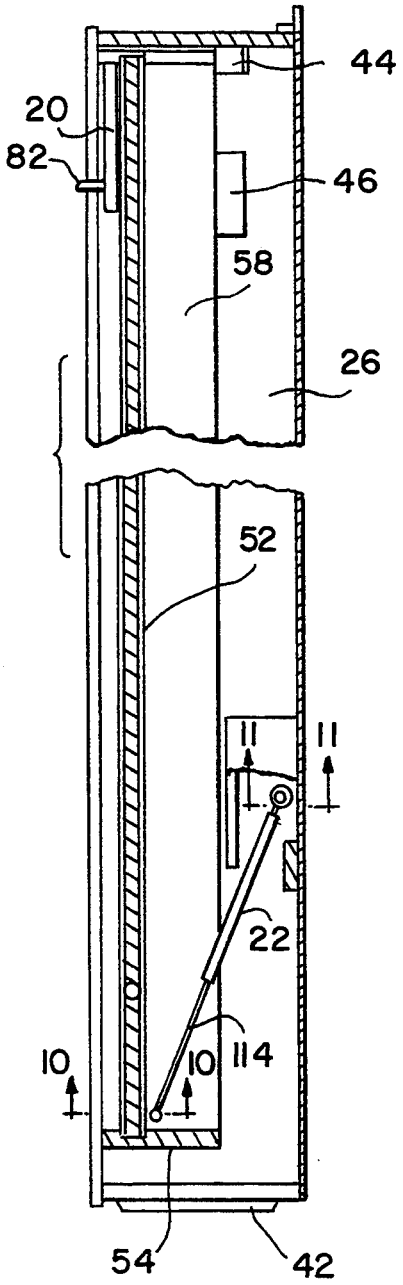
FIG. 4 is a section taken along line 4—4 of FIG. 3.
Figure 5:
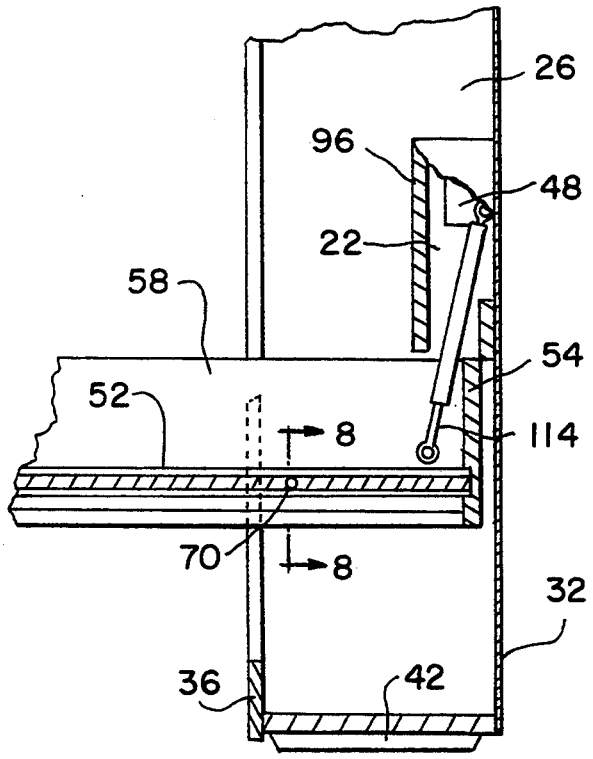
FIG. 5 is a section taken along line 5—5 of FIG. 1.

A wall bed assembly 10 (FIG. 1) embodying the present invention includes a shell 12 attached to a wall 14 to which a bed pad 16 for receiving a mattress 18 is pivotally attached. The bed pad is provided with a hinged foot 20 which also serves as the handle for opening the bed assembly. The weight of the bed pad is counter-balanced by a pair of gas springs 22 (FIGS. 4 and 5) which serves to bias the bed pad toward the vertical or closed position.

Figure 2:
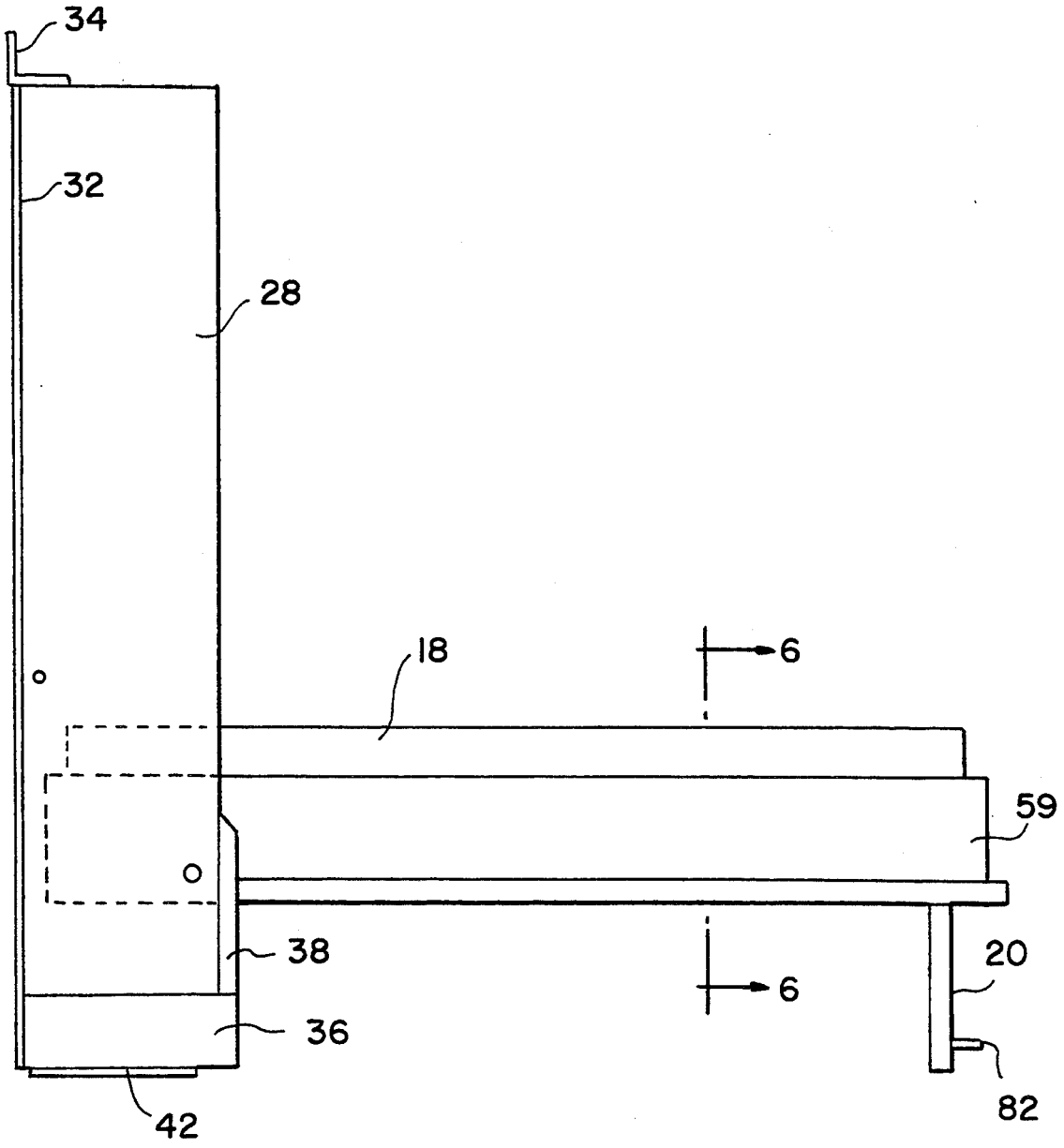
FIG. 2 is a side view of the folding bed assembly shown in FIG. 1.
Figure 3:
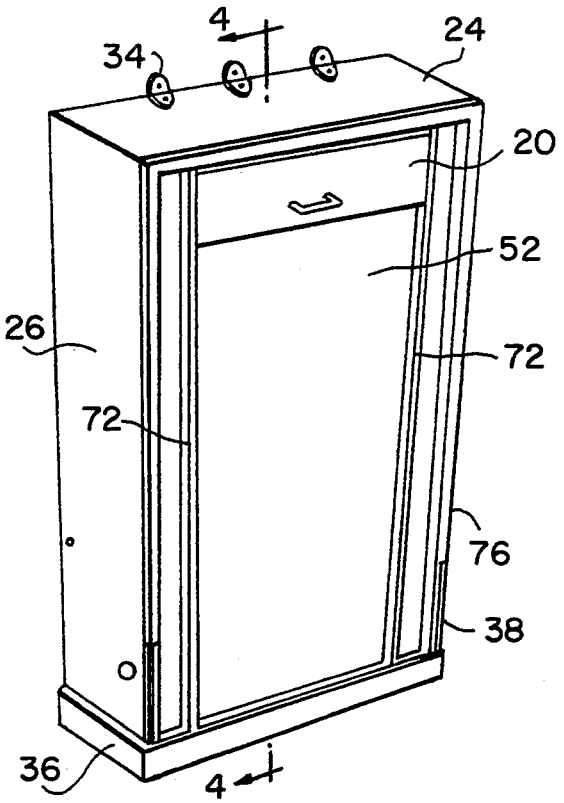
FIG. 3 is an isometric view of the folding bed assembly embodying the present invention showing it in a closed position.

The box-shaped shell 12 (FIGS. 1–3) includes a top wall 24, a pair of side walls 26 and 28, and a bottom wall 30, each of which is secured to a back wall 32. The shell is secured to the adjacent wall 14 by a plurality of wall brackets 34. Surrounding the bottom wall 30 is a skirt 36. Extending outwardly from the side walls 26 and 28 of the shell 12 are a pair of facia 38. Extending downwardly from the skirt are a pair of feet 42 to support the shell on the floor. For purposes of properly locating the bed pad 16 within the shell 12 when the bed assembly 10 is in the closed position, a pair of wedge-shaped bed pad guides 44 (FIGS. 1, 2 and 4) are secured to side walls 26 and 28 adjacent to the top wall 24. A pair of bed pad stops 46 are located adjacent to the bed pad guides to limit the movement of the bed pad into the shell. A pair of anchor blocks 48 (FIGS. 5 and 11) are secured to the side walls 26 and 28 of the shell for attachment of the gas spring 22.

Figure 6:
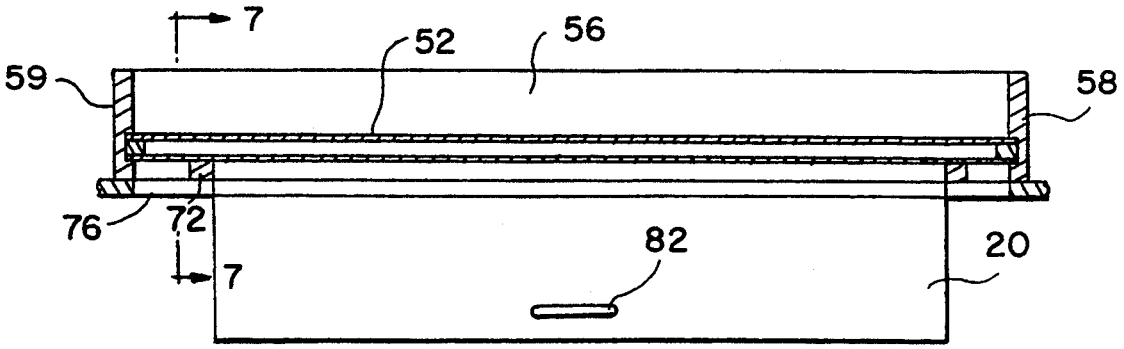
FIG. 6 is a section taken along line 6—6 of FIG. 2.
Figure 7:
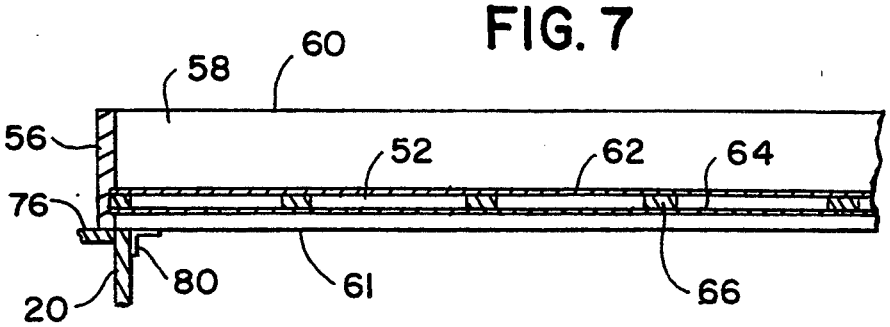
FIG. 7 is a section taken along line 7—7 of FIG. 6.

Like the shell 12, the bed pad 16 (FIGS. 1–3) is also box-shaped and is sized and configured to fit within the shell. Thus, a box-within-a-box construction is achieved. The bed pad includes a rectangularly-shaped pad base 52 mortised (FIGS. 6 and 7) into a head rail 54, a foot rail 56, and a pair of side rails 58 and 59 to form a five-sided open box which is sized to receive and hold the conventional bed mattress 18 with a small degree of extra room to allow for making the bed with fitted sheets. Each of the rails 54, 56, 58 and 59 have a top edge 60 and a bottom edge 61 (FIG. 7). The pad base is mortised adjacent to the bottom edge of the rails.

Figure 8:
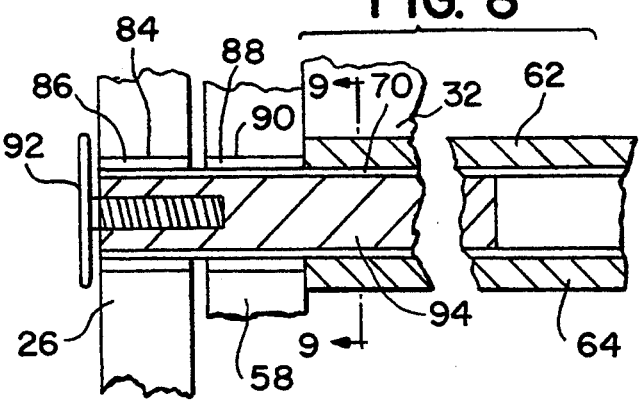
FIG. 8 is a section taken along line 8—8 of FIG. 5.
Figure 9:
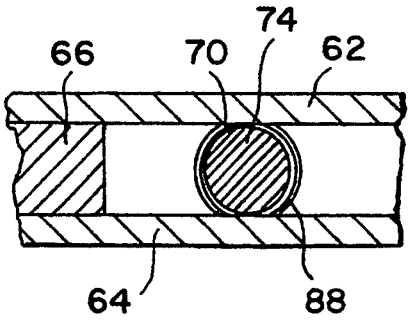
FIG. 9 is a section taken along line 9—9 of FIG. 8.

The pad base 52 is of a sandwiched construction (FIGS. 6 and 7), including an upper skin or panel 62 and a lower skin or panel 64 secured on either sides of a plurality of intermediate cross spars 66. Near a head end of the pad base 68, a tubular, transverse axle 70 (FIGS. 5, 8 and 9) in the form of a metal conduit pipe is retained and secured between the upper and lower skin. The preferred distance from the head end to the axle will depend upon the size of the bed and specifically the height of the rails 54, 56, 58 and 59. The axle is employed for connection of the pad base to the shell 12. For further strength and aesthetic appeal, a pair of ribs 72 (FIG. 3) run longitudinally along the outer surface of the lower skin 64 from the head end 68 to a foot end 74 of the pad base. Along the bottom edge of the foot rail 56, a bed pad facia 76 (FIGS. 1 and 7) is secured.

For the dual purposes of pulling the bed assembly 10 into an open position and for supporting the foot end 74 of the pad base 52, the foot 20 (FIGS. 1, 2, 3, 6 and 7) is attached by a hinge 80 to the outer surface of the lower skin 64 adjacent to the foot end 74. The hinge allows the foot to swing from a position parallel and adjacent to the pad base 52 to a position perpendicular to the pad base and contacting the bed pad facia 56. For ease of use, the foot is provided with a handle 82 which may be grasped by the user. It can be appreciated that the foot 20 may freely swing under the force of gravity to positions including and between the previously described parallel and perpendicular positions relative to the pad base.

To achieve the pivotal connection between the bed pad 16 and the shell 12, the transverse axle 70 extends outwardly on either side of the bed pad and passes through apertures 84 (FIG. 8) defined in the side walls 26 and 28 of the shell. Bushings 86 are provided in each aperture for journaling a received end of the axle. A pair of second axle bushings 88 are located in the side rails 58 and 59 in apertures 90 defined therein. The ends of the transverse axle 70 are covered by a pair of pivot axle covers 92 in the form of cap bolts which are screwed into a wooden plug 94 within the axle.

The gas springs 22 for biasing the bed pad 16 toward a vertical position are well known conventional devices. Each of the gas springs are partially enclosed within a corresponding gas spring cover 96 (FIGS. 1 and 5) secured to the respective side walls 26 and 28 of the shell 12. Each of the gas springs are connected at the base end to one of the respective side walls 26 and 28, preferably near to the attachment of the side walls to the back wall 32. Defined within the anchor block 48 and the side wall are a pair of aligned corresponding apertures 100 and 102 (FIG.11) through which a standard carriage bolt 103 is placed to anchor the base end of the gas spring. The gas spring 22 includes an eyelet 104 which is placed onto the carriage bolt and retained by a lock washer 106 and hex nut 108. The carriage bolt is retained within the shell by a flat washer 110 and hex nut 112.

The gas spring 22 includes an extendable piston arm 114 which extends from the base of the spring 22 and has a mounting eyelet 116 (FIG. 10) at the end thereof. This eyelet is pivotally retained by an anchor bolt 118 secured to the side rails 58 and 59 of the bed pad in a conventional manner by a t-nut 120 which engages the side rail, and a flat washer 122 and hex nut 124. The location of this pivotal connection of the spring to the side rail is preferably between the top edge 60 of the side rail and the attachment to the pad base 52, being closer to the latter, and between the transverse axle 70 and the head rail 54, being closer to the latter. The precise location of this pivotal connection is determined by a variety of factors including the weight of the bed pad 16 and the mattress 18, but preferably the connection is located near the coincidence of the side rail, head rail and pad base. In this manner, the gas spring 22 is connected at its ends to the shell and the bed pad respectively, and serves to bias the bed pad into a vertical position within the shell.

Preferably, the gas spring will counter-balance a majority of the weight with a residual lifting force required in the range of five to fifteen pounds. This is to prevent unintentional closing of the bed. The force requirement and the position of the gas spring may be approximated by solution of the following equation:

$$LA \times WC = LB \times CWFRD,$$

where:

LA = the length from the transverse axle to the foot rail;

LB = the length from the transverse axle to the pivotal connection of the gas spring to the shell (taken in the horizontal plane when the bed assembly is in the open position);

WC=the weight or force required to lift the foot end of the bed pad at the foot rail if no spring were present (less fifteen pounds residual weight as desired); and CWFRD=the counter weight force requirement of the gas springs together (for two gas springs, each is CWFRD/2).

Preferably, the mattress 18 is retained within the box-shaped bed pad 16 by a mattress strap 130 (FIGS. 12–14) which passes around the mattress and is secured at either end to a mattress strap anchor 132. With this strap in place, the mattress is secured to the bed pad to prevent movement of the mattress during movement of the bed pad between the open and closed position.

A presently preferred embodiment of the present invention has been described above with a degree of specificity. It should be understood, however, that this degree of specificity is directed toward the preferred embodiment. For example, instead of a sandwiched construction, the bed pad could include a honeycomb structure or an expanded foam. Similarly, the counterbalance member could include other types of springs or weights and levers instead of a gas spring. The invention itself, however, is defined by the scope of the appended claims.

The invention claimed is:

1. A folding bed assembly for selectively and alternatively moving between a horizontal position and a vertical position adjacent to a vertical support surface, comprising:

a support assembly operatively connected to the vertical support surface;

a bed pad including a bed pad base, a foot rail, a head rail and a pair of side rails secured together and into which the bed pad base is mortised to form an open, rectangular box, said pad being receptive of a bed mattress, and including a transverse axle for pivotally connecting to the support assembly adjacent to said head rail of the bed pad, a pair of ribs secured to a bottom surface of the bed pad base and extending from the head rail to the foot rail, said bed pad base being partially hollow;

a counter-balancing member operatively connected between said support assembly and said bed pad so that the bed pad is biased toward the vertical position to assist in moving the bed pad to the vertical position and to counter-balance the force of gravity in moving the bed pad to the horizontal position; and a bed foot pivotally connected by a hinge to the bottom surface of the bed pad base adjacent to the foot rail of the bed pad, said pivotal connection allowing the bed foot to gravitationally swing to a vertical position perpendicular to the bottom surface of the bed pad when the bed pad is horizontal and parallel to the bottom surface of the bed pad when the bed pad is vertical, said bed foot having a handle mounted thereon for grasping, wherein the bed foot is sized and positioned to fit between the pair of ribs when the bed pad is vertical.

2. A folding bed assembly for selectively and alternatively moving between a horizontal position and a vertical position adjacent to a vertical support surface, comprising:

a cabinet including a top wall, a bottom wall, a pair of side walls, all of which are secured to a back wall, said cabinet secured to the vertical support surface by a plurality of wall brackets;

a mattress;

a bed pad for receiving and supporting the mattress and pivotally connected to the cabinet and including a bed pad base mortised into a head rail, a foot rail, and a pair of side rails, wherein said bed pad base includes an upper skin and a lower skin connected together by a plurality of cross spars;

a bed foot pivotally connected by a hinge to the lower skin of the bed pad base adjacent to the foot rail, said pivotal connection allowing the bed foot to gravitationally swing to a vertical position perpendicular to the bottom surface of the bed pad when the bed pad is horizontal and parallel to the bottom surface of the bed pad when the bed pad is vertical, said bed pad having a handle mounted thereon for grasping;

a pair of elongated gas springs connected at a first end to the side walls of the cabinet and at a second end to the side rails of the bed pad to bias the bed pad toward the vertical position to assist in moving the bed pad to the vertical position and to counter-balance the force of gravity in moving the bed pad to the horizontal position;

a mattress strap and anchor for securing the mattress into the bed pad wherein the anchor is secured to the upper skin of the bed pad base and wherein the mattress strap may be removably attached to the anchor;

a pair of wedge-shaped bed pad guides located on the side walls of the cabinet to guide the bed pad into the proper position to help to properly locate the bed pad within the cabinet when the bed pad is in the vertical position; and a pair of bed pad stops attached to the side walls of the cabinet to contact the bed pad and prevent further pivotal movement into the cabinet when the bed pad is in the vertical position.

3. A folding bed assembly for selectively and alternatively moving between a horizontal position and a vertical position adjacent to a vertical support surface, comprising:

a cabinet support assembly operatively connected to the vertical support surface;

a bed pad comprising upper and lower panels each with a head and foot end and opposed sides said pad encasing an unitary transverse axle between said upper and lower panels and projecting from both sides of the bed pad for pivotally connecting the bed pad axle into bushings housed by the cabinet support assembly, said axle positioned adjacent to and offset a predetermined distance from the head end of the bed pad to afford a mechanical advantage to a counterbalance mechanism mounted on the head end of the bed pad.

4. An assembly as defined in claim 3, wherein said bed pad has a facia mounted along its outside edges.

* * * * *